US005301433A

United States Patent [19]

Rogers

[11] Patent Number: 5,301,433

[45] Date of Patent: Apr. 12, 1994

[54] CAN OPENER AND JAR SEALING APPARATUS

[76] Inventor: Jon C. Rogers, P.O. Box 2411, Yucca Valley, Calif. 92286

[21] Appl. No.: 9,058

[22] Filed: Jan. 26, 1993

[51] Int. Cl.[5] ..... B67B 7/46

[52] U.S. Cl. ..... 30/401; 30/423; 81/3.32; 7/152

[58] Field of Search ..... 30/401, 423, 424; 7/151, 152; 81/3.2, 3.33, 3.32; 215/295

[56] References Cited

U.S. PATENT DOCUMENTS 2,579,189 12/1951 Jenson ..... 30/423
2,803,057 8/1957 Meader ..... 30/401
2,860,410 11/1958 McNally ..... 30/423
3,795,158 3/1974 Morita ..... 81/3.32
3,950,801 4/1976 Morrison ..... 7/152
4,028,805 6/1977 Figlia ..... 30/423
4,171,650 10/1979 Cardinal ..... 81/3.32

*Primary Examiner*—Richard K. Seidel
*Assistant Examiner*—Hwei-Siu Payer
*Attorney, Agent, or Firm*—Leon Gilden

[57] ABSTRACT

A housing having a cavity is arranged for mounting within a cabinet structure, with the apparatus to include a first drive motor to effect selective rotation in a clockwise and counter-clockwise manner to permit the selective closure and removal of jar lids relative to an associated jar employing threaded interconnection, with a second motor arranged for operative and selective actuation of a can opening device.

3 Claims, 4 Drawing Sheets

CAN OPENER AND JAR SEALING APPARATUS

BACKGROUND OF THE INVENTION

1. Field of the Invention

The field of invention relates to can opener apparatus, and more particularly pertains to a new and improved can opener and jar sealing apparatus wherein the same is arranged for the selective can opening and lid mounting of a lid structure relative to an associated jar.

2. Description of the Prior Art

Lid opening and closure devices of various types have been utilized throughout the prior art where typically, the securement of a lid relative to a jar, as well as the function of opening cans and the like, require a multitude of devices, wherein the instant invention provides for a single housing cavity arranged to accommodate such multi-function structure and in this respect, the present invention substantially fulfills this need.

SUMMARY OF THE INVENTION

In view of the foregoing disadvantages inherent in the known types of can opener apparatus now present in the prior art, the present invention provides a can opener and jar sealing apparatus wherein the same is directed to the selective opening of cans and jars, as well as the remounting of jar lids relative to associated jars in a threaded interconnection. As such, the general purpose of the present invention, which will be described subsequently in greater detail, is to provide a new and improved can opener and jar sealing apparatus which has all the advantages of the prior art can opener apparatus and none of the disadvantages.

To attain this, the present invention provides a housing having a cavity arranged for mounting within a cabinet structure, with the apparatus to include a first drive motor to effect selective rotation in a clockwise and counter-clockwise manner to permit the selective closure and removal of jar lids relative to an associated jar employing threaded interconnection, with a second motor arranged for operative and selective actuation of a can opening device.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved can opener and jar sealing apparatus which has all the advantages of the prior art can opener apparatus and none of the disadvantages.

It is another object of the present invention to provide a new and improved can opener and jar sealing apparatus which may be easily and efficiently manufactured and marketed.

It is a further object of the present invention to provide a new and improved can opener and jar sealing apparatus which is of a durable and reliable construction.

An even further object of the present invention is to provide a new and improved can opener and jar sealing apparatus which is susceptible of a low cost of manufacture with regard to both materials and labor, and which accordingly is then susceptible of low prices of sale to the consuming public, thereby making such can opener and jar sealing apparatus economically available to the buying public.

Still yet another object of the present invention is to provide a new and improved can opener and jar sealing apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
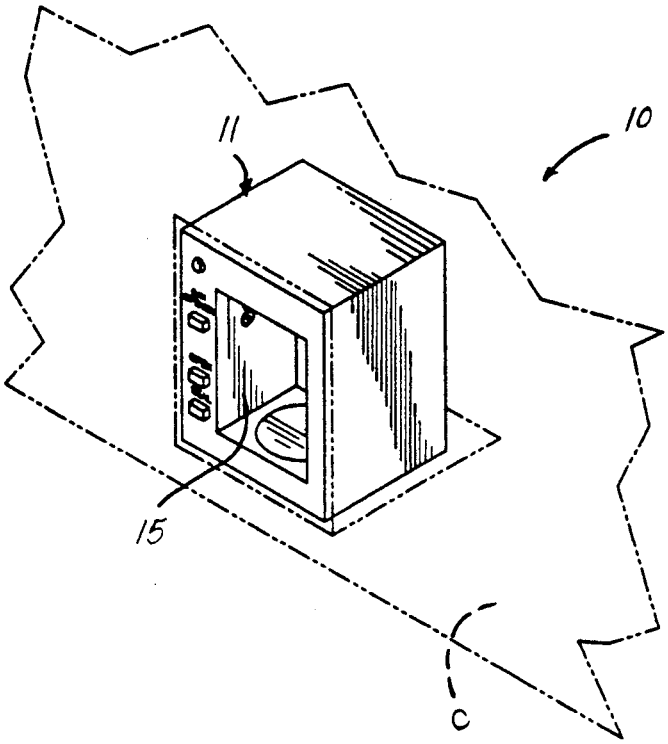
FIG. 1 is an isometric illustration of the invention mounted within a cabinet structure.
Figure 2:
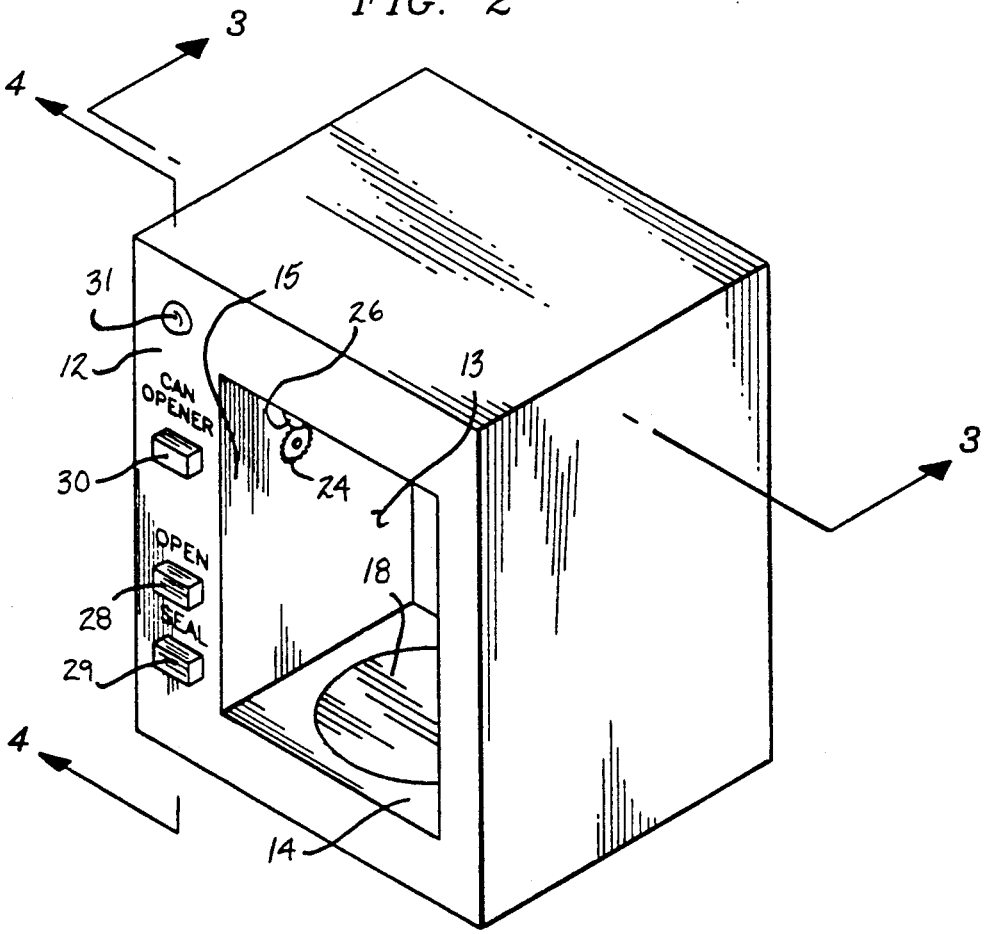
FIG. 2 is an enlarged isometric illustration of the housing structure of the invention.
Figure 3:
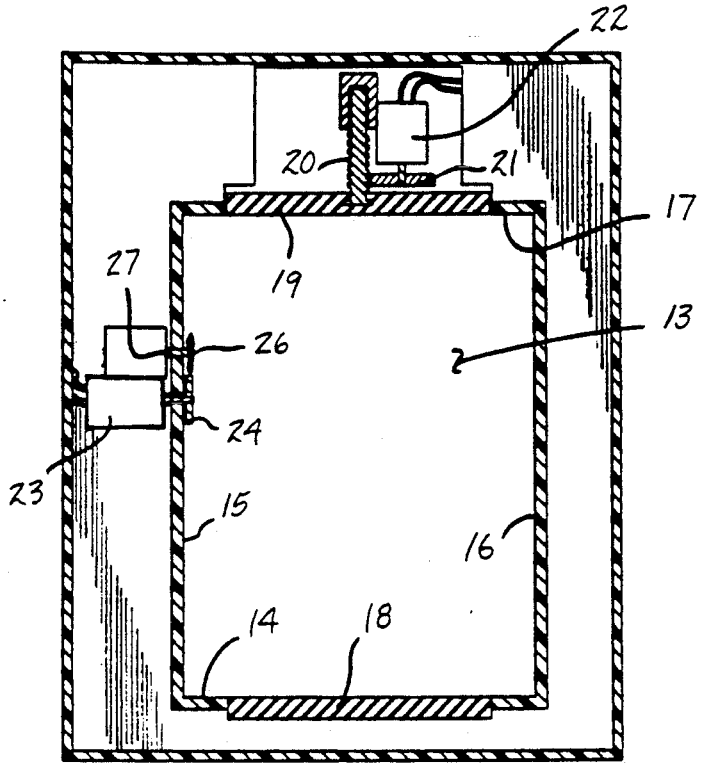
FIG. 3 is an orthographic view, taken along the lines 3—3 of FIG. 2 in the direction indicated by the arrows.
Figure 4:
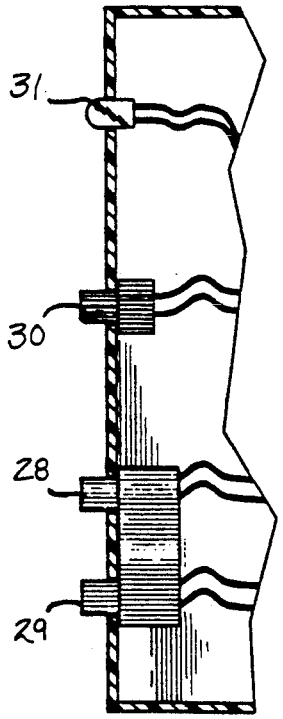
FIG. 4 is an orthographic view, taken along the lines 4—4 of FIG. 2 in the direction indicated by the arrows.

With reference now to the drawings, and in particular to FIGS. 1 to 7 thereof, a new and improved can opener and jar sealing apparatus embodying the principles and concepts of the present invention and generally designated by the reference numeral 10 will be described.

More specifically, the can opener and jar sealing apparatus 10 of the instant invention essentially comprises a housing 11 arranged for reception within a cabinet front wall "C", as illustrated in FIG. 1, with the housing 11 having a housing front wall 12 having a housing cavity 13 directed into the housing from the front wall 12. The housing cavity 13 includes a cavity rigid floor 14, with spaced cavity first and second side walls 15 and 16 and a cavity roof plate 17. A resilient anvil plate 18 is fixedly mounted substantially medially of the cavity floor 14 aligned with and positioned below a rotary resilient roof plate pad 19 rotatably mounted relative to the housing roof plate 17 by a gear rack 20 coaxially aligned and fixedly mounted to the roof plate pad 19. The gear rack 20 is in operative communication with a gear drive 21 in a threaded interconnection to direct the roof plate pad 19 towards or away from the anvil pad 18 dependent upon rotation of the first drive motor 22 of reversible construction mounted to the gear drive 21. A second drive motor 23 is provided and positioned between the first side wall 15 within the housing 11, with the second drive motor gear drive 24 arranged for cooperation relationship with an annular can opener cutter 26 to effect opening of a can upon rotation of the drive gear 24 in a manner well known in the can opener art in the cooperation of a drive gear relative to an opener cutter. The annular can opener cutter 26 is mounted to a cutter shaft 27, as illustrated.

A first motor first switch 28 effects rotation in a first direction of the gear rack 20 by first rotation of the first drive motor 22, with a first motor second switch 29 effective to displace the roof plate pad 19 relative to the anvil pad 18 by a contra-rotation of the gear rack 20 by contra-rotation of the first drive motor 22. A second motor switch 30 is arranged to effect rotation of the second drive motor drive gear 24 for the opening of a can member. A function indicator light 31 is provided to effect and indicate actuation of the first or second drive motors 22 and 23.

Figure 5:
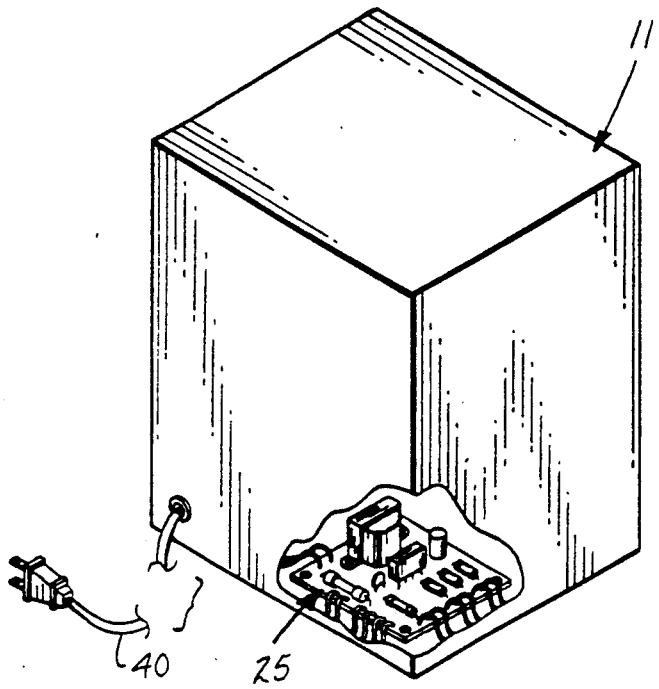
FIG. 5 is an isometric rear view, partially in section, of the control panel structure of the invention.
Figure 6:
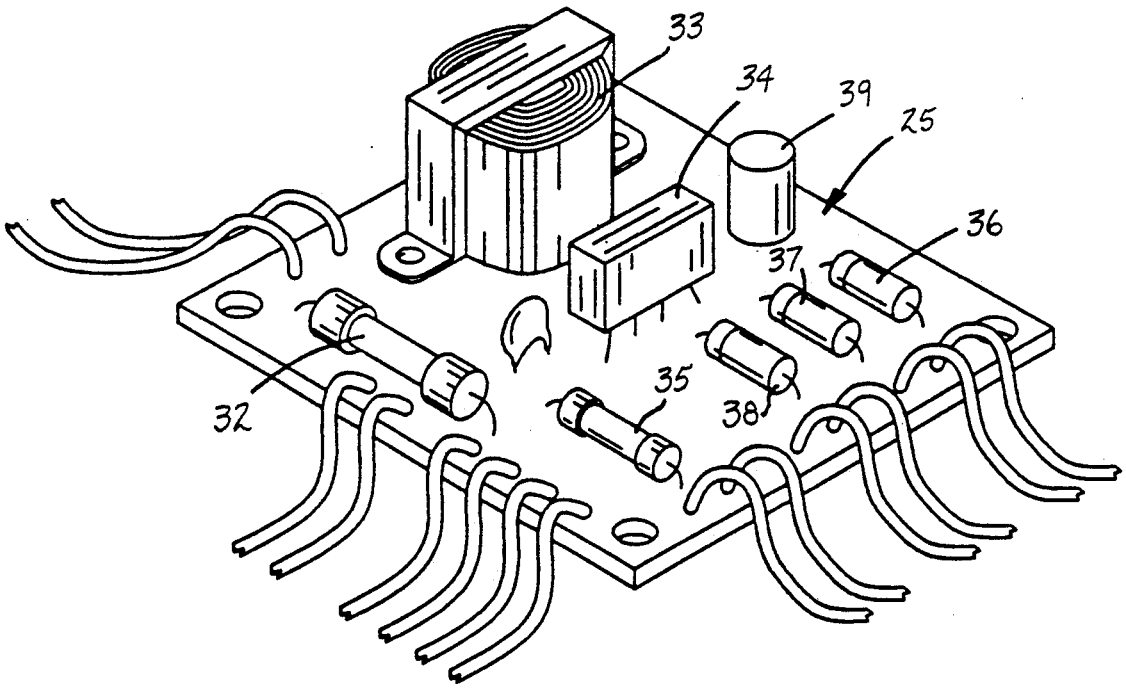
FIG. 6 is an enlarged isometric illustration of the control panel structure.
Figure 7:
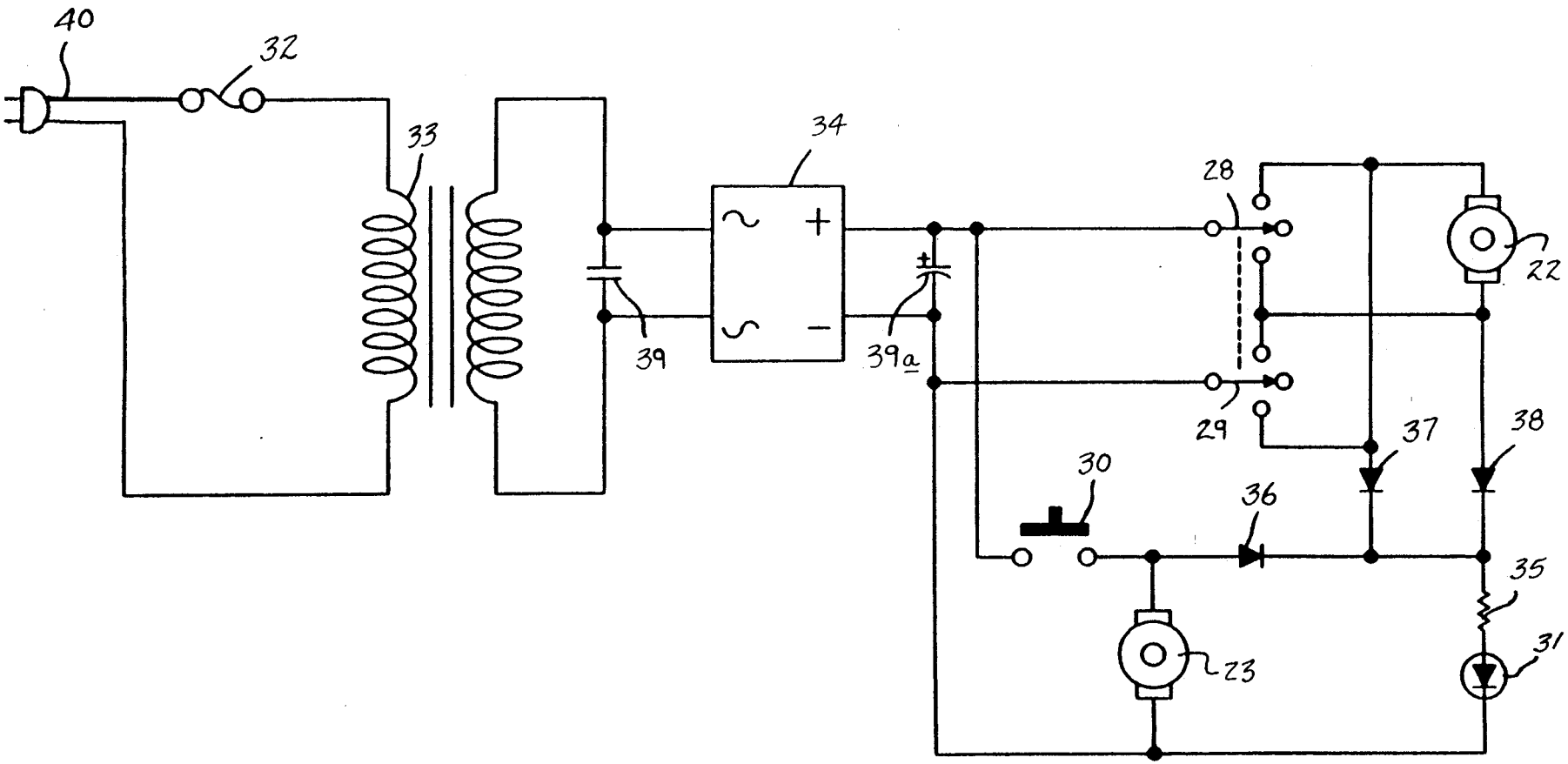
FIG. 7 is an orthographic diagrammatic illustration of the control circuitry employed by the invention.

With reference to the FIGS. 5–7 indicates the circuit control member 25 indicated in the FIG. 6 and diagrammatically in the FIG. 7, having a transformer 33 operative through a whetstone bridge rectifier 34, and employing the use of a capacitor 39 in parallel to isolate motor noise relative to the electrical power supply 40 and avoid possible interference with other electrical appliances. The second capacitor **39*a* is employed as a ripple filter. The resistor 35 is employed to limit current to the function indicator light 31. With the first drive motor first switch 28 actuated or closed, rotation to project rotatably the top roof plate pad 19 towards the anvil pad 18 is effects, whereupon actuation of the first drive motor second switch 29 effects contra-rotation of the first drive motor 22 to effect removal of a lid, typically threadedly engaged relative to a jar member of conventional construction (not shown). Actuation of the second motor switch 30 effects actuation of the drive gear 24. The respective first, second, and third diodes 36, 37, and 38 respectively are employed relative to the circuit lines relative to the first and second drive motors 22, 23, and the switches 28 and 29 to effect a gate structure to isolate the function indicator light 31 relative to other electrical impulses within the circuit of the invention. Fuse member 32 is provided in the circuit adjacent the power supply 40**.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A can opener and jar sealing apparatus, comprising, a housing, the housing including a housing front wall, a housing cavity directed into the housing through the front wall, with the housing cavity having a cavity floor spaced from a roof plate, and a first side wall spaced from a second side wall, and a resilient anvil pad mounted to the floor in a fixed orientation, and a resilient rotary roof plate pad rotatably mounted relative to the roof plate, and first drive means provided within said housing for effecting selective rotation and contra-rotation of the roof plate pad relative to the anvil pad, and a can opener cutter mounted to the first side wall, and a can opener drive gear arranged in cooperation with the can opener cutter, and second drive means provided within said housing for effecting selective rotation of the can opener drive gear.

2. An apparatus as set forth in claim 1 wherein the first drive means includes a first drive motor, and the second drive means includes a second drive motor, wherein the first drive motor is reversible, and the housing front wall having a, first motor first switch and a first motor second switch for actuating said first drive motor, and a second motor switch for actuating said second drive motor, and a function indicator light to effect visual indication of selective actuation of the can opening drive gear and the first drive means.

3. An apparatus as set forth in claim 2 wherein the rotary roof plate pad includes a gear rack, and the rear rack fixedly and orthogonally mounted medially of the rotary roof plate pad coaxially aligned relative to the rotary roof plate pad and the anvil pad, and a gear drive arranged for cooperation with the gear rack, with the gear drive mounted to the first drive motor, and the first drive motor reversible to effect selective movement of said rotary roof plate pad towards or away from the anvil pad.

* * * * *